US007861541B2

(12) United States Patent
Dieckmann et al.

(10) Patent No.: US 7,861,541 B2
(45) Date of Patent: Jan. 4, 2011

(54) SYSTEM AND METHOD OF REFRIGERATION

(75) Inventors: John T. Dieckmann, Belmont, MA (US); Detlef Westphalen, Roslindale, MA (US)

(73) Assignee: Tiax LLC, Lexington, MA (US)

( * ) Notice: Subject to any disclaimer, the term of this patent is extended or adjusted under 35 U.S.C. 154(b) by 26 days.

(21) Appl. No.: 11/181,689

(22) Filed: Jul. 13, 2005

(65) Prior Publication Data

US 2006/0130495 A1 Jun. 22, 2006

Related U.S. Application Data

(60) Provisional application No. 60/587,692, filed on Jul. 13, 2004.

(51) Int. Cl.
*F25B 9/00* (2006.01)

(52) U.S. Cl. ..... 62/87; 62/116

(58) Field of Classification Search ..... 62/87, 62/114, 154, 402, 498; 418/55.1, 55, 55.5
See application file for complete search history.

(56) References Cited

U.S. PATENT DOCUMENTS

| | | | |
|---|---|---|---|
| 808,897 | A | 1/1906 | Carrier |
| 1,956,707 | A | 5/1934 | Carrier |
| 2,154,263 | A | 4/1939 | Carrier |
| 3,986,799 | A | 10/1976 | McCullough |
| 3,994,633 | A | 11/1976 | Shaffer |
| 3,994,635 | A | 11/1976 | McCullough |
| 3,994,636 | A | 11/1976 | McCullough et al. |
| 4,065,279 | A | 12/1977 | McCullough |
| 4,082,484 | A | 4/1978 | McCullough |
| 4,121,438 | A | 10/1978 | McCullough |
| 4,129,405 | A | 12/1978 | McCullough |
| 4,160,629 | A | 7/1979 | Hidden et al. |
| 4,192,152 | A | 3/1980 | Armstrong et al. |
| 4,199,308 | A | 4/1980 | McCullough |
| 4,259,043 | A | 3/1981 | Hidden et al. |
| 4,395,205 | A | 7/1983 | McCullough |
| 4,403,494 | A | 9/1983 | McCullough |
| 4,424,010 | A | 1/1984 | McCullough |
| 4,436,495 | A | 3/1984 | McCullough |
| 4,463,591 | A | 8/1984 | McCullough |
| 4,472,120 | A | 9/1984 | McCullough |
| 4,512,066 | A | 4/1985 | McCullough |

(Continued)

FOREIGN PATENT DOCUMENTS

| | | |
|---|---|---|
| EP | 0256793 B1 | 1/1991 |

(Continued)

OTHER PUBLICATIONS

*Rohm & Haas Co.* v. *Crystal Chemical Co.* C.A. Fed., 1983; Westlaw 722 F.2d 1556; pp. 1-18.

(Continued)

*Primary Examiner*—Mohammad M Ali
(74) *Attorney, Agent, or Firm*—Karen B. King

(57) ABSTRACT

In a refrigeration system, an asymmetric scroll expander has an orbiting scroll element engaged with a fixed scroll element. The orbiting scroll element and fixed scroll element can define a first expansion pocket and a second expansion pocket at positions relative to one another.

38 Claims, 13 Drawing Sheets

U.S. PATENT DOCUMENTS 4,892,469 A 1/1990 McCullough et al.
4,911,621 A 3/1990 McCullough et al.
4,927,340 A 5/1990 McCullough
5,051,075 A 9/1991 Young
5,145,344 A 9/1992 Haga et al.
5,149,255 A 9/1992 Young
5,222,882 A 6/1993 McCullough
5,224,849 A 7/1993 Forni
5,228,309 A 7/1993 McCullough
5,247,795 A 9/1993 McCullough
RE34,413 E 10/1993 McCullough
5,256,042 A 10/1993 McCullough et al.
5,258,046 A 11/1993 Haga et al.
5,286,179 A 2/1994 Forni et al.
5,314,316 A 5/1994 Shibamoto et al.
5,328,341 A 7/1994 Forni
5,330,463 A 7/1994 Hirano
5,337,560 A 8/1994 Abdelmalek
5,354,184 A 10/1994 Forni
5,360,566 A 11/1994 Stevenson
5,421,192 A 6/1995 Henry
RE35,370 E 11/1996 Henry
5,637,942 A 6/1997 Forni
5,660,057 A 8/1997 Tyree, Jr.
5,736,063 A 4/1998 Richard
5,746,719 A 5/1998 Farra et al.
5,800,140 A 9/1998 Forni
6,073,454 A 6/2000 Spauschus
6,082,132 A 7/2000 Numoto
6,106,740 A 8/2000 Powell
6,112,547 A 9/2000 Spauschus
6,113,803 A 9/2000 Richard
6,117,356 A 9/2000 Powell
6,131,404 A 10/2000 Hase
6,306,803 B1 10/2001 Tazaki
6,321,564 B1 11/2001 Yamanaka et al.
6,334,764 B1 * 1/2002 Kobayashi et al. ..... 418/55.5
6,374,621 B1 4/2002 Berchtold
6,415,614 B1 7/2002 Greenfield
6,427,479 B1 8/2002 Komatsubara
6,438,993 B2 8/2002 Takeuchi
6,461,120 B2 * 10/2002 Harakawa et al. ..... 417/371
6,484,519 B1 11/2002 Hesse
6,500,358 B2 12/2002 Singh
6,514,059 B1 * 2/2003 Takeuchi et al. ..... 418/55.3
6,543,238 B2 4/2003 Yamanaka et al.
6,584,802 B1 7/2003 Cofield
6,613,725 B1 9/2003 Tazaki
6,631,617 B1 * 10/2003 Dreiman et al. ..... 62/84
6,649,079 B2 11/2003 Cho
6,670,454 B2 12/2003 Lai
6,688,115 B1 2/2004 Gershtein
6,698,214 B2 3/2004 Chordia
6,827,563 B2 12/2004 Hiwata
6,840,058 B2 1/2005 Suzuki et al.
6,843,930 B2 1/2005 Cho
6,854,283 B2 2/2005 Nakatani
6,871,511 B2 3/2005 Okaza
6,887,925 B1 5/2005 Kobayashi
6,890,163 B2 * 5/2005 Uchida et al. ..... 418/55.4
2001/0012489 A1 * 8/2001 Harakawa et al. ..... 417/371
2001/0037653 A1 11/2001 Yamanaka et al.
2001/0042380 A1 11/2001 Cho
2002/0000534 A1 1/2002 Richard
2002/0039541 A1 * 4/2002 Kobayashi et al. ..... 418/55.5
2002/0098993 A1 7/2002 Ohsumi
2002/0121623 A1 9/2002 Singh
2002/0195234 A1 12/2002 Wu
2003/0084666 A1 * 5/2003 Ogawa et al. ..... 60/597
2003/0140649 A1 7/2003 Suzuki
2003/0161747 A1 * 8/2003 Satoh ..... 418/55.2
2003/0178597 A1 9/2003 Cho
2003/0199401 A1 10/2003 Tazaki
2004/0003622 A1 * 1/2004 Negishi ..... 62/402
2004/0021124 A1 2/2004 Cho
2004/0069011 A1 4/2004 Nishida
2004/0099838 A1 5/2004 Leck
2004/0118134 A1 6/2004 Matsumoto
2004/0118138 A1 6/2004 Nakatani
2004/0123621 A1 7/2004 Okaza
2004/0136854 A1 * 7/2004 Kimura et al. ..... 418/55.4
2004/0200233 A1 10/2004 Funakoshi
2004/0206109 A1 10/2004 Nishiwaki
2005/0044885 A1 3/2005 Pearson

FOREIGN PATENT DOCUMENTS

EP 0297514 B1 3/1992
EP 0351204 B1 5/1992
EP 0372029 B1 5/1992
EP 0309242 B1 6/1992
EP 0350290 B1 12/1992
EP 0343662 B1 5/1993
EP 0203961 B1 6/1993
EP 0393950 B1 11/1993
EP 0345919 B1 12/1993
EP 0375207 B1 1/1994
EP 0380439 B1 1/1994
EP 0353764 B1 2/1994
EP 0421910 B1 2/1994
EP 0432084 B1 2/1994
EP 0452896 B1 2/1994
EP 0322894 B1 3/1994
EP 0426206 B1 3/1994
EP 0354867 B1 5/1994
EP 0427659 B1 5/1994
EP 0435815 B1 6/1994
EP 0385737 B1 9/1994
EP 0408221 B1 9/1994
EP 0478269 B1 11/1994
EP 0478378 B1 11/1994
EP 0438026 B1 1/1995
EP 0648825 A1 4/1995
EP 0457603 B1 7/1995
EP 0402870 B1 8/1995
EP 0464282 B1 9/1995
EP 0322804 B1 11/1995
EP 0478795 B1 11/1995
EP 0680503 A1 11/1995
EP 0467342 B1 1/1996
EP 0475538 B1 5/1996
EP 0469700 B1 7/1996
EP 0472248 B1 9/1996
EP 0464970 B1 10/1996
EP 0779354 A1 6/1997
EP 0446635 B1 5/1998
EP 0845019 A1 6/1998
EP 0845020 A1 6/1998
EP 0845021 A1 6/1998
EP 0845022 A1 6/1998
EP 0663371 B1 3/1999
EP 0770112 B1 4/1999
EP 0770113 B1 4/1999
EP 0915309 A2 5/1999
EP 0922076 A1 6/1999
EP 1013738 A1 6/2000
EP 1063279 A1 12/2000
EP 1160522 A1 12/2001
EP 0998545 B1 5/2002
EP 1203807 A1 5/2002
EP 1215451 A1 6/2002
EP 1306629 A1 5/2003
EP 0980416 B1 7/2003
EP 1344995 A1 9/2003

| | | | |
|---|---|---|---|
| EP | 1365152 | A1 | 11/2003 |
| EP | 1263619 | B1 | 12/2003 |
| EP | 1416232 | A1 | 5/2004 |
| EP | 1431684 | A1 | 6/2004 |
| EP | 1467158 | A2 | 10/2004 |
| EP | 1491608 | A1 | 12/2004 |
| EP | 1491616 | A1 | 12/2004 |
| EP | 1517041 | A2 | 3/2005 |
| JP | 04-283367 | | 10/1992 |
| JP | 05-004041 | | 1/1993 |
| JP | 06-017040 | | 1/1994 |
| JP | 06-220435 | | 8/1994 |
| JP | 06-273003 | | 9/1994 |
| JP | 06-330867 | | 11/1994 |
| JP | 07-126673 | | 5/1995 |
| JP | 07-159004 | | 6/1995 |
| JP | 07-218009 | | 8/1995 |
| JP | 08-028461 | | 1/1996 |
| JP | 08-067870 | | 3/1996 |
| JP | 08-311438 | | 11/1996 |
| JP | 09-292168 | | 11/1997 |
| JP | 09-318168 | | 12/1997 |
| JP | 10-141814 | | 5/1998 |
| JP | 10-153363 | | 6/1998 |
| JP | 10-238872 | | 9/1998 |
| JP | 10-266983 | | 10/1998 |
| JP | 10-288429 | | 10/1998 |
| JP | 11-201588 | | 7/1999 |
| JP | 11-336665 | | 12/1999 |
| JP | 2000-055488 | | 2/2000 |
| JP | 2000-110730 | | 4/2000 |
| JP | 2000-146321 | | 5/2000 |
| JP | 2000-146372 | | 5/2000 |
| JP | 2000-161213 | | 6/2000 |
| JP | 2000-171108 | | 6/2000 |
| JP | 2000-192025 | | 7/2000 |
| JP | 2000-283077 | | 10/2000 |
| JP | 2000-319647 | | 11/2000 |
| JP | 2000-355213 | | 12/2000 |
| JP | 2001-019944 | | 1/2001 |
| JP | 2001-049282 | | 2/2001 |
| JP | 2001-074342 | | 3/2001 |
| JP | 2001-107881 | | 4/2001 |
| JP | 2001-108257 | | 4/2001 |
| JP | 2001-126657 | | 5/2001 |
| JP | 2001-215072 | | 8/2001 |
| JP | 2001-221379 | | 8/2001 |
| JP | 2001-255028 | | 9/2001 |
| JP | 2001-255029 | | 9/2001 |
| JP | 2001-255030 | | 9/2001 |
| JP | 2001-255031 | | 9/2001 |
| JP | 2001-272139 | | 10/2001 |
| JP | 2001-279289 | | 10/2001 |
| JP | 2001-280762 | | 10/2001 |
| JP | 2001-294886 | | 10/2001 |
| JP | 2001-330348 | | 11/2001 |
| JP | 2001-343173 | | 12/2001 |
| JP | 2001-347127 | | 12/2001 |
| JP | 2001-355588 | | 12/2001 |
| JP | 2002-022298 | | 1/2002 |
| JP | 2002-048421 | | 2/2002 |
| JP | 2002-061571 | | 2/2002 |
| JP | 2002-071231 | | 3/2002 |
| JP | 2002-180074 | | 6/2002 |
| JP | 2002-180075 | | 6/2002 |
| JP | 2002-188872 | | 7/2002 |
| JP | 2002-220595 | | 8/2002 |
| JP | 2002-228283 | | 8/2002 |
| JP | 2002-235072 | | 8/2002 |
| JP | 2002-243290 | | 8/2002 |
| JP | 2002-243320 | | 8/2002 |
| JP | 2002-243321 | | 8/2002 |
| JP | 2002-364562 | | 12/2002 |
| JP | 2002-364562 | A * | 12/2002 |
| JP | 2002-372383 | | 12/2002 |
| JP | 2003-065615 | | 3/2003 |
| JP | 2003-074990 | | 3/2003 |
| JP | 2003-121018 | | 4/2003 |
| JP | 2003-130479 | | 5/2003 |
| JP | 2003-194427 | | 7/2003 |
| JP | 2003-240366 | | 8/2003 |
| JP | 2003-246976 | | 9/2003 |
| JP | 2003-264002 | | 9/2003 |
| JP | 2003-287293 | | 10/2003 |
| JP | 2003-327748 | | 11/2003 |
| JP | 2003-327750 | | 11/2003 |
| JP | 2003-329314 | | 11/2003 |
| JP | 2003-336916 | | 11/2003 |
| JP | 2003-336918 | | 11/2003 |
| JP | 2003-343933 | | 12/2003 |
| JP | 2004-170007 | | 6/2004 |
| JP | 2004-190916 | | 7/2004 |
| JP | 2004-190917 | | 7/2004 |
| JP | 2004-198063 | | 7/2004 |
| JP | 2004-257303 | | 9/2004 |
| JP | 2004-263096 | | 9/2004 |
| JP | 2004-301453 | | 10/2004 |
| JP | 2004-309045 | | 11/2004 |
| JP | 2004-360931 | | 12/2004 |
| JP | 2005-015633 | | 1/2005 |
| WO | WO 9216597 | A1 | 10/1992 |
| WO | WO 9411458 | A1 | 5/1994 |
| WO | WO 9417153 | A1 | 8/1994 |
| WO | WO 9602603 | A1 | 2/1996 |
| WO | WO 9602604 | A1 | 2/1996 |
| WO | WO 9602605 | A1 | 2/1996 |
| WO | WO 9602606 | A1 | 2/1996 |
| WO | WO 9707179 | A1 | 2/1997 |
| WO | WO 9707180 | A1 | 2/1997 |
| WO | WO 9707181 | A1 | 2/1997 |
| WO | WO 9707182 | A1 | 2/1997 |
| WO | WO 9741190 | A1 | 11/1997 |
| WO | WO 9808912 | A1 | 3/1998 |
| WO | WO 0032934 | A1 | 6/2000 |
| WO | WO 0068621 | A1 | 11/2000 |
| WO | WO 0102521 | A1 | 1/2001 |
| WO | WO 0109237 | A1 | 2/2001 |
| WO | WO 0112763 | A1 | 2/2001 |
| WO | WO 0168393 | A1 | 9/2001 |
| WO | WO 0220689 | A1 | 3/2002 |
| WO | WO 0220690 | A1 | 3/2002 |
| WO | WO 0250482 | A1 | 6/2002 |
| WO | WO 03083383 | A1 | 10/2003 |
| WO | WO 2004015042 | A2 | 2/2004 |
| WO | WO 2004051162 | A1 | 6/2004 |
| WO | WO 2005036072 | A1 | 4/2005 |

OTHER PUBLICATIONS

IP Landscape—Scroll Expander (May 24, 2005) Tiax LLC; Reference A0050.06; pp. 1-17.

Arthur D. Little, Inc., 2000, "Development of a Second Generation Scroll Compressor/Expander Module for Automotive Fuel Cell Applications," Report to the U.S. Department of Energy, Reference 34780.

M. Richter et al., 2000, "Transcritical $CO_2$ Heat Pump for Residential Application," *Proceedings of the 4th IIR-Gustav Lorentzen Conference on Natural Working Fluids at Purdue*, West Lafayette, Indiana, USA, pp. 59-67.

M. Preissner et al., 2000, "Comparison of Automotive Air Conditioning Systems Operating with $CO_2$ and R134a," *Proceedings of the 4th IIR-Gustav Lorentzen Conference on Natural Working Fluids at Purdue*, West Lafayette, Indiana, USA, pp. 191-198.

M. Richter et al., 2001, "Effect of Comfort Constraints on Cycle Efficiencies," *Proceedings of the 2001 ASME International Mechanical Engineering Congress and Exposition*, NY, NY, pp. 275-286.

R. Heidelck et al., 2000, "Expansion Machines for Carbon Dioxide Based on Modified Reciprocating Machines," *Proceedings of the 4th IIR-Gustav Lorentzen Conference on Natural Working Fluids at Purdue*, West Lafayette, Indiana, USA, pp. 455-462.

D. Robinson et al., 1998, "Efficiencies of Transcritical $CO_2$ Cycles with and without an Expansion Turbine," *International Journal of Refrigeration*, vol. 21, No. 7, pp. 577-589.

D. Li et al., 2000, "Thermodynamic Analysis of Vortex Tube and Work Output Expansion Devices for the Transcritical Carbon Dioxide Cycle," *Proceedings of the 4th IIR-Gustav Lorentzen Conference on Natural Working Fluids at Purdue*, West Lafayette, Indiana, USA, pp. 463-470.

P. Heyl et al., 2000, "Transcritical $CO_2$ Cycle With Expander-Compressor," *Proceedings of the 4th IIR-Gustav Lorentzen Conference on Natural Working Fluids at Purdue*, West Lafayette, Indiana, USA, pp. 471-478.

Military Specification, Air Conditioners: Vertical and Horizontal, Compact, MIL-A-52767D, Feb. 8, 1989.

Purchase Description, Air Conditioner, Horizontal and Vertical, Compact, PD 4120-0121, Jun. 8, 2001.

Arthur D. Little, Inc., "Global Comparative Analysis of HFC and Alternative Technologies for Refrigeration, Air Conditioning, Foam, Solvent, Aerosol Propellant, and Fire Protection Applications," Mar. 21, 2002, Final Report to the Alliance for Responsible Atmospheric Policy, Cambridge, Massachusetts, Reference 75966.

"Cooling Down With Carbon Dioxide," http://ibs.howstuffworks.com/ibs/des/news-item76.htm; publication date unknown, printed May 21, 2004, pp. 1-2.

"How Refrigerators Work—Parts of a Refrigerator," http://ibs.howstuffworks.com/ibs/des/refrigerator2.htm, publication date unknown, printed May 21, 2004, pp. 1-2.

"How Refrigerators Work—The Refrigeration Cycle," http://ibs.howstuffworks.com/ibs/des/refrigerator4.htm, publication date unknown, printed May 21, 2004, pp. 1-2.

"Small Ammonia Refrigerator," http://www.nh3tech.org/absorption.html, publication date unknown, printed May 21, 2004, pp. 1-5.

Max Alexander, "Cold Comfort—New Technology makes air conditioners perform better, last longer, and run quieter," *This Old House*, Jun. 2005, pp. 75-76.

J. Fleming, "Carbon Dioxide as the Working Fluid in Heating and/or Cooling Systems," *Bulletin of the IIR*—No. 2003-4—Review Article.

* cited by examiner

0 Degrees

90 Degrees

180 Degrees

270 Degrees

360/0 Degrees

450 Degrees

540 Degrees

630 Degrees

720 Degrees

810 Degrees

SYSTEM AND METHOD OF REFRIGERATION

CROSS-REFERENCE TO RELATED APPLICATION

This application claims the benefit under 35 U.S.C. §119 to U.S. Provisional Patent Application Ser. No. 60/587,692, titled SCROLL EXPANDER FOR CARBON DIOXIDE REFRIGERATION CYCLES, filed on Jul. 13, 2004.

FEDERALLY SPONSORED RESEARCH

This invention was made with Government support under U.S. Army Contract No. DAAB15-03-C-0001 and U.S.A. C.E.C.O.M. Acquisition Contract No. W909MY-04-C-0043. The Government may have certain rights to the invention.

BACKGROUND OF THE INVENTION

1. Field of the Invention

The invention is directed to scroll-type devices as well as to refrigeration systems and, in particular, to refrigeration systems utilizing scroll-type expansion devices.

2. Description of Related Art

Devices having scrolled features have been disclosed. For example, in a scroll compression process, an intermeshing of two spirals, or involutes, which interweave in an eccentric path, form a series of crescent shaped pockets as one scroll orbits relative to the other. Such techniques have been utilized in compressors wherein gas at low temperature and pressure enters at a periphery and is compressed as the pocket decreases in size, until it is discharged at a higher temperature and pressure.

Indeed, Armstrong et al., in U.S. Pat. No. 4,192,152, teach a scroll-type fluid displacement apparatus with peripheral drive. The orbiting scroll member is attached through radially-compliant linking means to eccentrics mounted on three equally spaced crankshafts to accommodate differential thermal expansion without the generation of any appreciable elastic forces to increase bearing loads. The apparatus may be staged and employed as a compressor or expander.

Haga et al., in U.S. Pat. No. 5,145,344, teach scroll-type fluid machinery with offset passage to the exhaust port. The machine has an orbiting scroll with involute wraps projecting axially on each of opposite sides, a pair of stationary scrolls each with involute wraps which mate with the wraps of the orbiting scroll, and a main shaft inserted in a central axis hole of the stationary scrolls for driving the orbiting scroll in orbital movement. The internal ends of the wraps of the stationary scrolls are extended inwardly to an outer peripheral wall of a land part where the central axis hole is formed. The stationary scroll wraps are extended about a half turn longer than the wrap of the orbiting scroll and the internal ends of the wraps are almost in contact end to end at a desired phase during the orbiting movement of the orbiting scroll.

McCullough, in U.S. Pat. No. 4,129,405, teaches a scroll-type liquid pump wherein recessed liquid transfer passage means are provided in the end plates of the scroll members. The transfer passage means may be inner passages within the scroll involutes, outer passages outside the scroll involutes or a combination of inner and outer passages. The passages are configured to be opened substantially immediately after the orbiting involute wrap has reached that point in its orbiting cycle to define three essentially completely sealed-off liquid zones. The passages remain open at least until the liquid passages between the wraps are sufficiently large to prevent any substantial pressure pulsations within the scroll liquid pump.

Hirano, in U.S. Pat. No. 5,330,463, teaches a scroll-type fluid machinery with reduced pressure biasing the stationary scroll. The scroll type fluid machinery has a stationary scroll and a revolving scroll with spiral elements set up at end plates thereof. The scrolls are engaged with each other, and a high pressure fluid chamber is formed on the outside of the end plate of the stationary scroll. A low pressure fluid chamber or an intermediate pressure fluid chamber is formed between the end plate of the stationary scroll and the high pressure fluid chamber. The pressure of a low pressure fluid or an intermediate pressure fluid acts on the outside of the end plate of the stationary scroll, and deformation of the end plate is prevented or reduced, and reliability of the fluid machinery may be improved.

Forni, in U.S. Pat. No. 5,637,942, teaches an aerodynamic drag reduction arrangement for use in a mechanical device that incorporates a high speed rotating element. The arrangement includes a boundary layer control member that defines a control surface. The control member is positioned adjacent the rotating element so as to optimize the clearance therebetween in order to effectively block axial flow and prevent radial pumping in order to minimize power consumption.

Forni, in U.S. Pat. No. 5,800,140, teaches a compact scroll fluid device. The device includes a pair of wrap support elements with one of the wrap support elements having an inner axial surface formed with an involute spiral recess and the other of the wrap support elements having an involute spiral wrap member projecting from an inner axial surface thereof. The spiral wrap member is received within the spiral recess while being relatively movable about an orbital path between the wrap support elements, radially inwardly of both inlet and outlet zones associated with the scroll fluid device and radially outwardly of an orbit center of the device.

Yamanaka et al., in U.S. Pat. No. 6,321,564 and No. 6,543,238, teach a refrigerant cycle system with expansion energy recovery. The refrigerant of the system is compressed in a first compressor, is cooled and condensed in a radiator, and refrigerant from the radiator branches into main-flow refrigerant and supplementary-flow refrigerant. The main-flow refrigerant is decompressed in an expansion unit while expansion energy of the main-flow refrigerant is converted to mechanical energy. Thus the enthalpy of the main-flow refrigerant is reduced along an isentropic curve. Therefore, even when the pressure within the evaporator increases, refrigerating effect is prevented from being greatly reduced in the refrigerant cycle system. Further, refrigerant flowing into the radiator is compressed using the converted mechanical energy. Thus, coefficient of performance of the refrigeration cycle is improved.

Masayuki et al., in Japanese Patent No. 2004-257303, teach a scroll expansion machine and refrigerating air conditioner.

BRIEF SUMMARY OF THE INVENTION

The present invention, in accordance with one or more embodiments, can provide refrigeration systems having relatively enhanced energy recovery and, in some cases, decreased environmental impact associated with reduced greenhouse gas emissions.

In accordance with one or more embodiments, the invention provides an asymmetric scroll expander. The asymmetrical expander can comprise an orbiting scroll element engaged with a fixed scroll element; a first expansion pocket defined between the orbiting scroll element and the fixed scroll element at a first relative engagement position; and a second expansion pocket defined between the orbiting scroll element and the fixed scroll element at a second relative engagement position.

In accordance with one or more embodiments, the invention is directed to a refrigeration system comprising an asymmetric scroll expander comprising an orbiting scroll element engaged with a fixed scroll element; a first expansion pocket defined between the orbiting scroll element and the fixed scroll element at a first relative engagement position; and a second expansion pocket defined between the orbiting scroll element and the fixed scroll element at a second relative engagement position.

In accordance with one or more embodiments, the invention is directed to a refrigeration system. The system can comprise a refrigerant expansion device comprising a means for reducing the axial pressure force variation during expansion of a refrigerant; a heat exchanger having an outlet port in fluid communication with the expansion device; and a compressor in fluid communication with the evaporator and the heat exchanger.

In accordance with one or more embodiments, the invention is directed to an asymmetric scroll device. The asymmetric scroll device can comprise an orbiting scroll element engaged with a fixed scroll element; a first pocket defined between the orbiting scroll element and the fixed scroll element at a first relative engagement position; and a second pocket defined between the orbiting scroll element and the fixed scroll element at a second relative engagement position.

In accordance with one or more embodiments, the invention is directed to a method. The method can comprise one or more acts of expanding a transcritical fluid in at least one expansion pocket of an asymmetric scroll expander to generate mechanical work, and delivering the mechanical work to a rotating shaft.

Other advantages and features of the invention will be apparent from the detailed description of the invention when considered with the accompanying drawings, which are schematic and not drawn to scale. In the figures, each identical or substantially similar component is referenced or labeled by a numeral or notation. For clarity, not every component is labeled in every figure nor is every component of each embodiment of the invention shown where illustration is not necessary to allow those of ordinary skill in the art to understand the invention.

BRIEF DESCRIPTION OF THE DRAWINGS

Non-limiting embodiments of the present invention will be described by way of example with reference to the accompanying drawings in which.

DETAILED DESCRIPTION OF THE INVENTION

Figure 1:
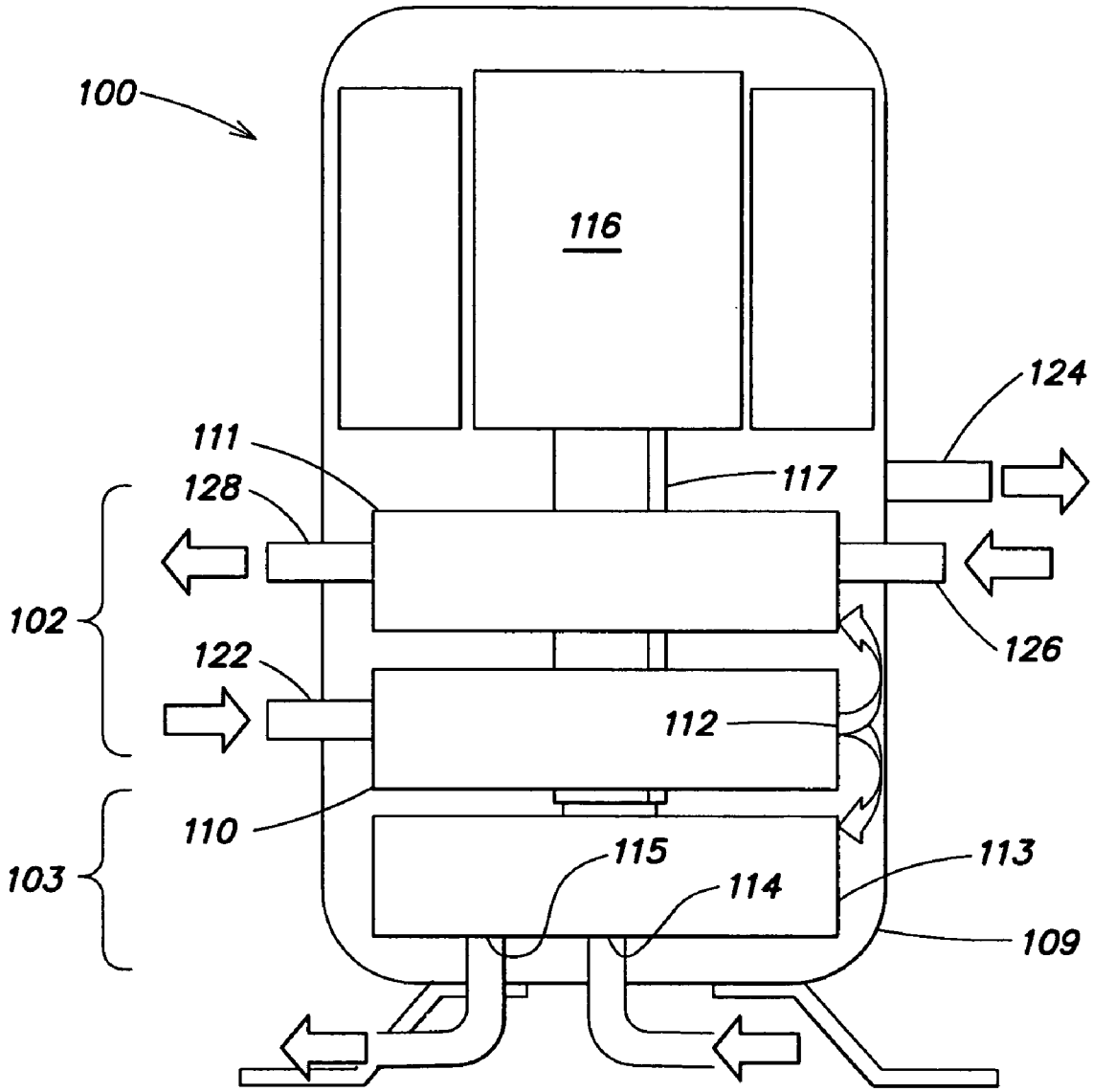
FIG. 1 is a schematic illustration showing a compression and expansion system in accordance with one or more embodiments of the invention.

A refrigeration cycle is a process of creating a cooling effect by cycling a refrigerant or refrigeration fluid, by compression and expansion, and allowing the refrigeration fluid to absorb heat and reject it to the surroundings. This process typically requires an external energy source, or, put another way, addition of work to the system. Typically, a motor provides the external energy.

In accordance with one or more embodiments, the systems and techniques of the invention can utilize a refrigerant that is an alternative to conventional refrigerants. For example, one or more aspects pertinent to one or more embodiments of the invention can advantageously utilize a transcritical fluid, such as, but not limited to a fluid comprising carbon dioxide, as a refrigerant. However, the thermodynamic cycle efficiency of transcritical carbon dioxide refrigeration systems can be lower than conventional fluorocarbon-based vapor systems. The present invention advantageously can facilitate the adaptation of transcritical fluids based systems through the operation of one or more work recovery devices.

Typically, a refrigeration cycle utilizes an evaporator, a compressor, a condenser or gas cooler, and an expansion device such as an expander or a throttle valve. The refrigerant is a fluid that is cycled through the system. In the evaporator, the refrigeration fluid absorbs heat, which can occur at a constant temperature. The compressor increases the pressure of the refrigerant, which is then cooled in the condenser. The pressure of the cooled refrigerant is reduced in the expander prior to introduction into the evaporator. The invention, in some aspects, advantageously utilizes the expansion stage to enhance the overall or effective efficiency of the refrigeration system. For example, the work associated with the expansion process can be used as energy to drive another entity such one or more unit operations. Thus, in accordance with one or more specific embodiments of the invention, this derived or recovered energy (work) can be used to drive an associated or ancillary device. Indeed, the recovered energy can provide at least a portion of the shaft work associated with the compression stage.

Various fluids have been used in the refrigeration cycle. The most widely used fluids are halogenated hydrocarbons. More specifically chlorofluorocarbons and hydrochlorofluorocarbons (HCFCs) have been the primary refrigerant fluid for stationary air conditioners. As these fluids were phased out due to their ozone depletion impact, hydrofluorocarbons (HFCs) were identified as a possible replacement because they do not contribute to ozone depletion. However, the latter are considered greenhouse gases that contribute to global warning. Because of the potential negative impact both HCFCs and HFCs have on the environment and the regulatory uncertainty surrounding their future use, "natural" refrigerants, such as carbon dioxide, hydrocarbons, and ammonia have been further evaluated as refrigeration fluids. Indeed, carbon dioxide is non-flammable and non-toxic and is also relatively inexpensive, widely available worldwide, and typically not subject to venting restrictions. Transcritical refrigerants such as carbon dioxide further provide advantages because of the high operating pressures.

Carbon dioxide based refrigeration systems typically operate at higher pressures than conventional systems. Additionally the high side operating temperatures typically exceed the critical temperature of carbon dioxide, about 30.9° C. This means the system operates in transcritical conditions. The evaporation process can occur at sub-critical, or two-phase conditions, and the heat rejection in the gas cooler can occur at super-critical conditions.

The thermodynamic cycle efficiency of transcritical carbon dioxide based refrigeration systems can be lower than conventional fluorocarbon-based vapor compression systems. Such refrigeration systems can further utilize thermodynamic processes to enhance efficiency. For example, one or more suction line heat exchangers may be utilized to cool the cooled high-pressure refrigerant from the gas cooler while heating the refrigerant vapor exiting the evaporator.

Indeed, the present invention can provide systems that are more reliable because of a reduction in complexity and in the number of moving parts. Some systems of the invention can further have low noise and vibration, and high efficiency, typically throughout their operating regime.

In accordance with one or more embodiments, the present invention provides an asymmetric scroll expander. The asymmetric scroll expander comprises an orbiting scroll element engaged with a fixed scroll element, a first expansion pocket defined between the orbiting scroll element and the fixed scroll element at a first relative engagement position, and a second expansion pocket defined between the orbiting scroll element and the fixed scroll element at a second relative engagement position.

In accordance with one or more embodiments, the present invention provides a refrigeration system comprising the asymmetric scroll expander.

In accordance with one or more embodiments, the present invention provides a method of expanding refrigerant. The method comprises introducing a transcritical fluid at a first pressure into an asymmetric scroll expander.

In accordance with one or more embodiments, the present invention provides a method. The method comprises the steps of expanding a transcritical fluid in at least one expansion pocket of an asymmetric scroll expander to generate shaft work and delivering the shaft work to a rotating shaft.

This invention provides an approach to improving the efficiency of refrigeration systems. In accordance with one or more embodiments, the efficiency of a refrigeration system can be enhanced by advantageously generating, recovering, or capturing energy in one stage and utilizing the recovered energy in another stage or in an ancillary system. In accordance with one or more particular embodiments, the invention is directed to recovering energy during the expansion stage and reducing the required energy in another stage by utilizing a work recovery device.

Figure 3:
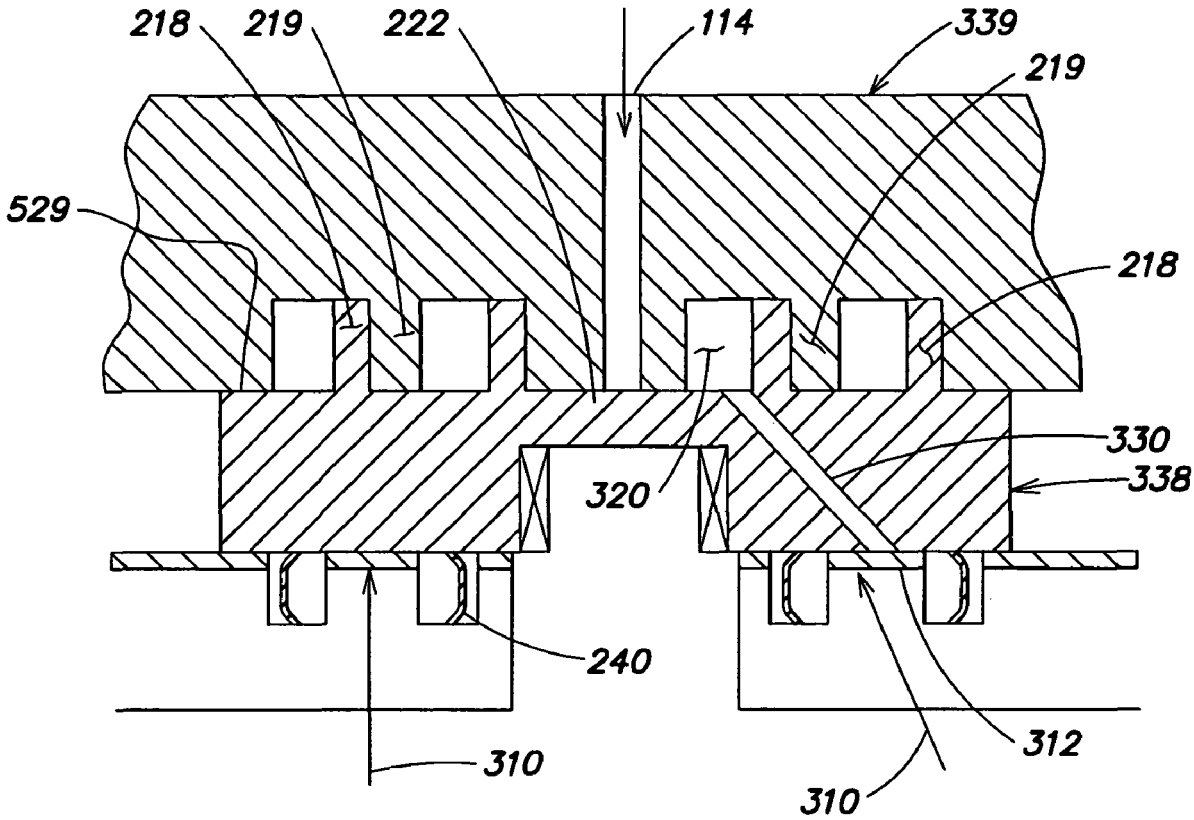
FIG. 3 is a schematic illustration showing a portion of an asymmetric scroll expansion device in accordance with one or more embodiments of the invention.

Throughout the following description, the term "scroll device" will be used to designate a component of the refrigeration system. Scroll devices typically have one or more fixed or stationary components and one or more correspondingly associated orbiting components. In scroll devices, the orbiting and fixed scroll elements are typically engaged to define one or more expansion pockets. Typically, the scroll elements are involute or spiral structures that extend or project from a corresponding structural member. For example, as schematically illustrated in FIG. 3, a scroll device comprises an orbiting scroll member 338 and a fixed or stationary scroll member 339. Orbiting scroll member 338 includes an orbiting spiral-shaped involute or orbiting scroll element 218 (also illustrated in FIGS. 8A to 8J). Likewise, fixed scroll member 339 includes a fixed spiral-shaped involute or fixed scroll element 219. Typically, the pitch, of the orbiting scroll element corresponds to the pitch of the fixed scroll element. The pitch is the center-to-center distance between adjacent walls of the scroll, along a datum reference line radiating from the center of the spiraling structure, of the involute.

Scroll devices can be characterized as having symmetrical or asymmetrical characteristics. Symmetrical scroll devices typically have engaging or interacting fixed and orbiting scroll elements that are mirror images of each other. Asymmetric scroll devices in contrast cannot be characterized as having an orbiting scroll element that is a mirror image of a fixed scroll element. For example, asymmetric scroll devices of the invention can have a spiral length of the orbiting scroll element shorter, or longer, than a spiral length of the fixed scroll element. The difference can be manifested at an internal or central end or at an external or outer end.

The engagement of the orbiting scroll element and the fixed scroll element defines a pocket or volume, where, if the scroll device serves as an expansion device, a fluid, typically gaseous, exerts an applied pressure on the orbiting scroll element resulting in translation of the orbiting scroll element. For example, one or more aspects pertinent to the engaged arrangement can define a first expansion pocket and a second expansion pocket during operation of the scroll device. The translation of the orbiting scroll element, typically around the circumference of a circle defined by an orbit radius, can be manifested as energy or work, expansion energy. Notably, expansion of the fluid can occur from, for example, its supercritical state to its liquid and/or gaseous state. Further discussion directed to the orbital translation and, in particular, to the expansion of a fluid in the scroll device follows below in reference to FIGS. 8A to 8J. The term "pocket" refers to a volume defined between an engaged set of orbiting and fixed scroll elements. As the orbiting scroll element translates relative to the fixed scroll element, the volume of the pocket increases or decreases, depending on the direction of relative orbital motion. The term "expansion pocket" will be used to designate the volume defined between an engagement of an orbiting scroll element and a fixed scroll element of a scroll device. Expansion pockets typically have a varying volume, increasing from the first relative engagement until fluid expanded in the expansion pocket has exited through one or more outlet ports. In accordance with one or more embodiments of the invention, a pocket is defined at an instant when the pocket has been fluidly isolated from an inlet port.

In accordance with one or more embodiments of the invention, expansion device 113 can comprise a scroll expander, a portion of which is schematically illustrated in FIG. 3. The scroll expander can be an asymmetric scroll expander comprising an orbiting scroll member 338 with an orbiting scroll element 218, which is shown engaged with a fixed scroll element 219 of a fixed scroll member 339. The engaged orbiting and fixed scroll elements can define at least one pocket 320 therebetween. As will be described in further detail below, with reference to FIGS. 8A to 8J, the pocket can volumetrically increase during translation of the orbiting member relative to the fixed member. As fluid is introduced through an inlet port 114, the orbiting scroll member of the asymmetric scroll expander translates and the volume of the defined pocket increases thereby reducing the pressure thereof until it is discharged through an outlet port.

In accordance with further embodiments, the systems and techniques of the invention can utilize integrated assembly principles. For example, one or more components and/or subsystems of a refrigeration system can be disposed in a common or single housing assembly. Indeed, some aspects of the invention are directed to systems and techniques that have the ability to operate in both the compression and expansion modes using the same basic mechanical configurations. A single compressor-expander module is contemplated, thus providing a compact and highly efficient approach for utilizing recovered energy.

For example, FIGS. 1 to 6 depict a system 100 having compressor 102 and expansion 103 segments in a vessel 109. Compression segment or subsystem 102 can be comprised of a single stage or a plurality of stages, e.g. a first compression stage 110 and a second compression stage 111. Expansion subsystem 103 can comprise one or more expansion devices 113. Vessel 109 can be designed and constructed and arrange to be pressurized, internally, such that an internal pressure thereof is intended to be greater than atmospheric pressure.

Figure 4:
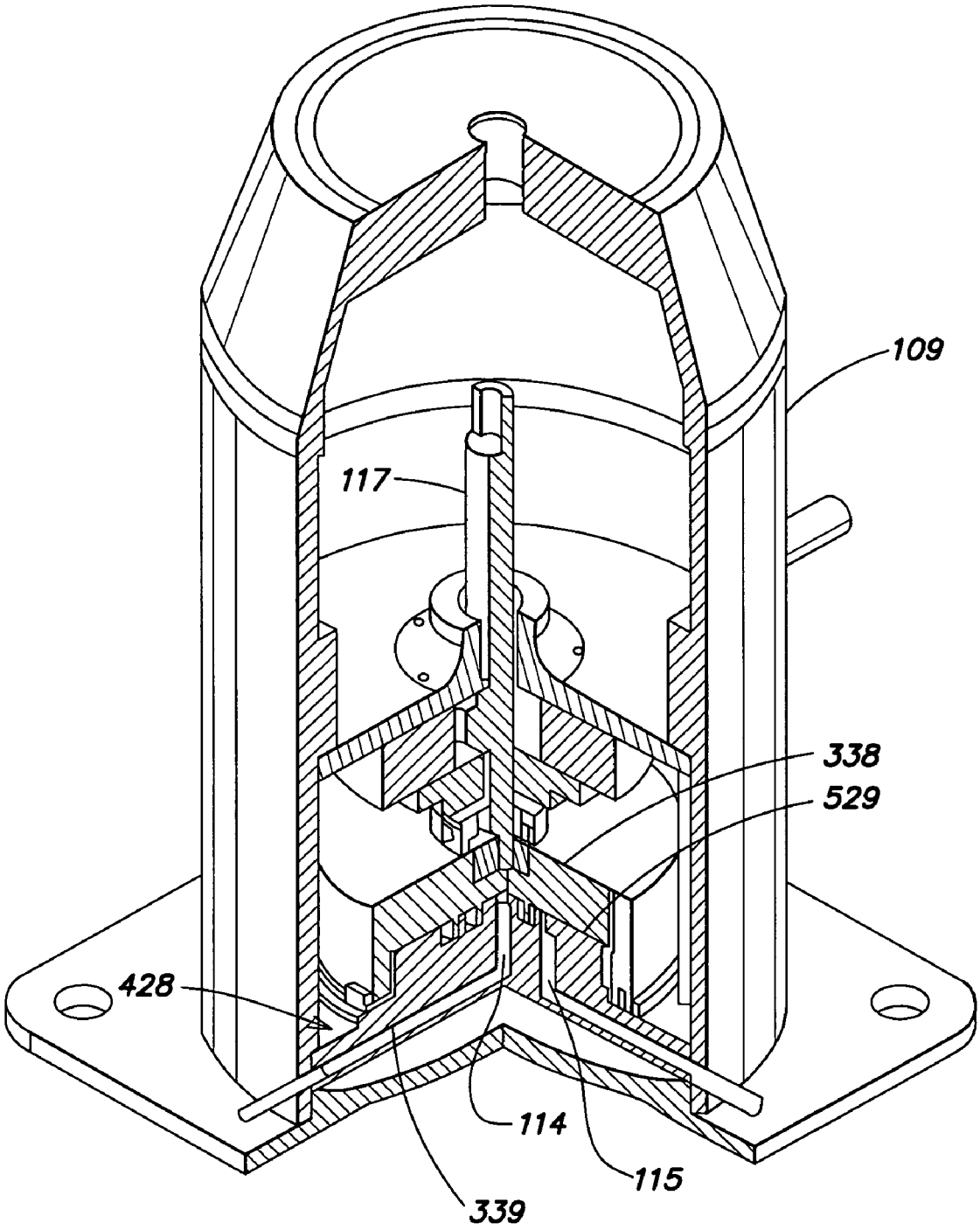
FIG. 4 is a schematic illustration showing a longitudinal cross-sectional view of an asymmetric scroll expander disposed in a vessel in accordance with one or more embodiments of the invention.
Figure 5:
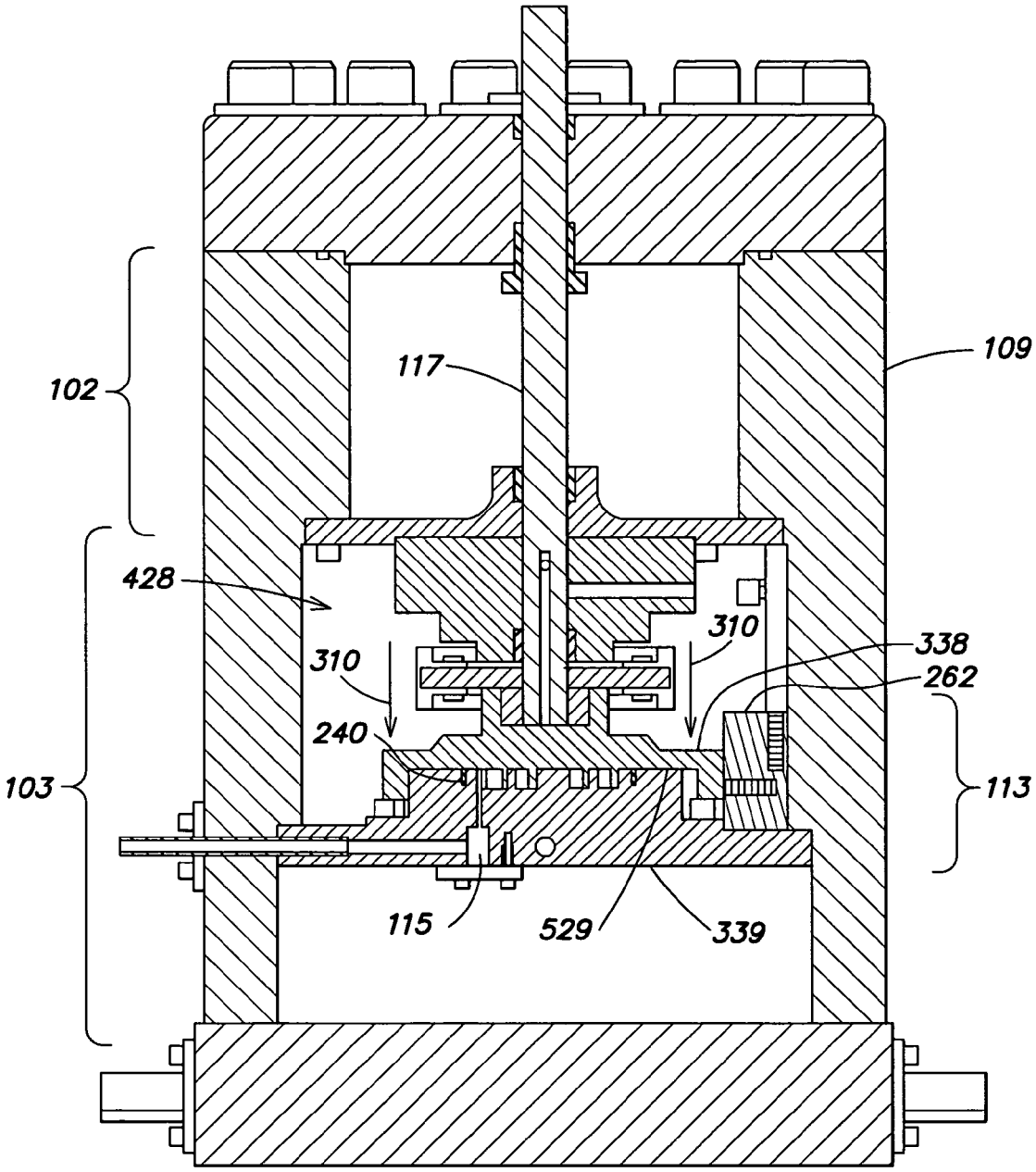
FIG. 5 is a schematic illustration showing a sectional view of an asymmetric scroll expander in accordance with one or more embodiments of the invention.
Figure 6:
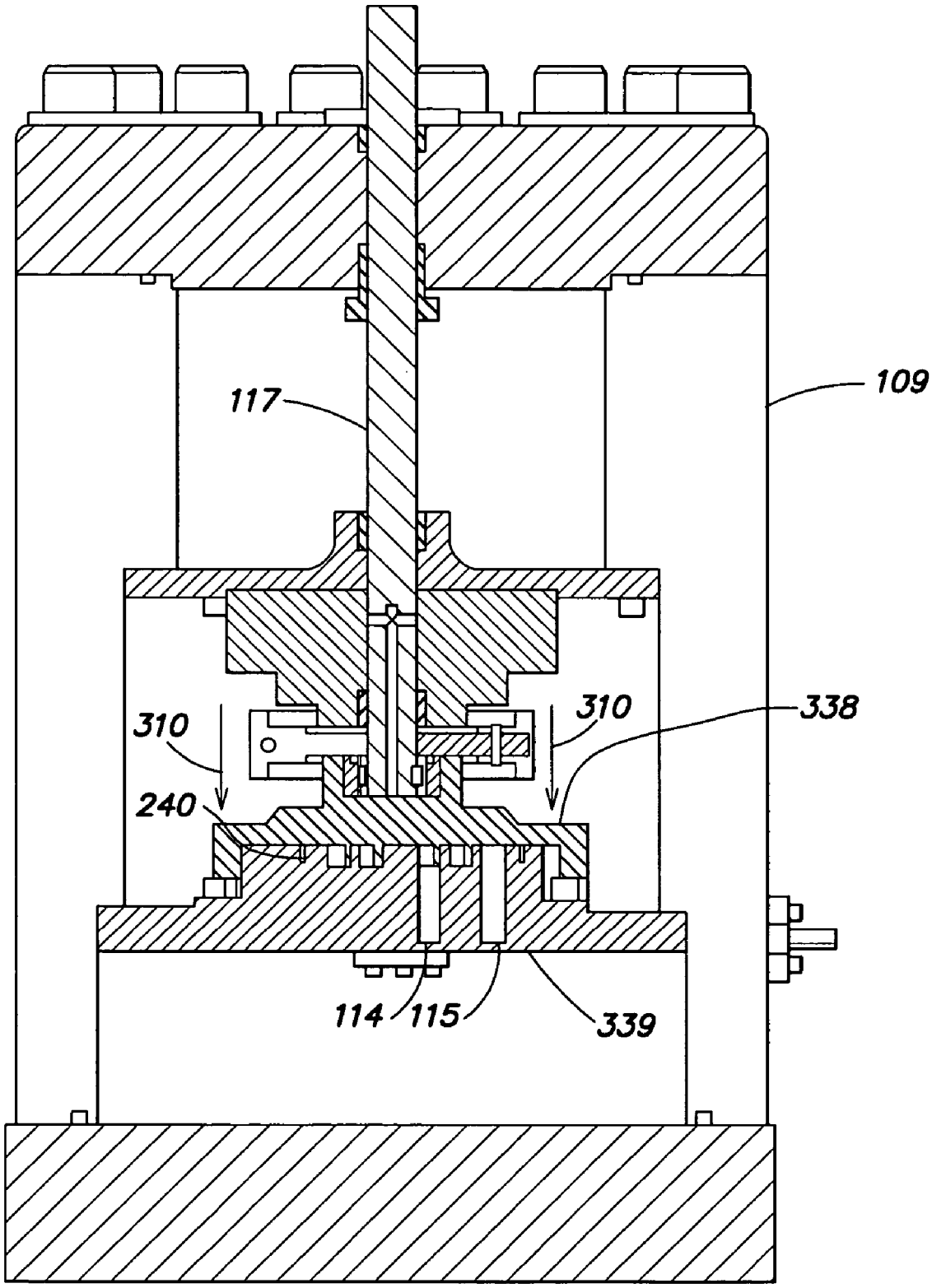
FIG. 6 is another schematic illustration showing an alternate longitudinal cross-sectional view of the asymmetric scroll expander housed in a vessel in accordance with one or more embodiments of the invention.

For example, FIGS. 4 to 6 are schematic illustrations showing a longitudinal cross-sectional view (FIG. 4) and an assembled, sectional view (FIGS. 5 and 6) of an integrated compression subsystem (not shown) with an expansion device in accordance with one or more embodiments of the invention. In particular, the expansion subsystem can comprise an expander having a fixed or stationary component 339 and a movable, non-stationary component 338. Movable component 338 can be a member orbiting stationary component 339 along a predefined or predetermined path.

Figure 1B:
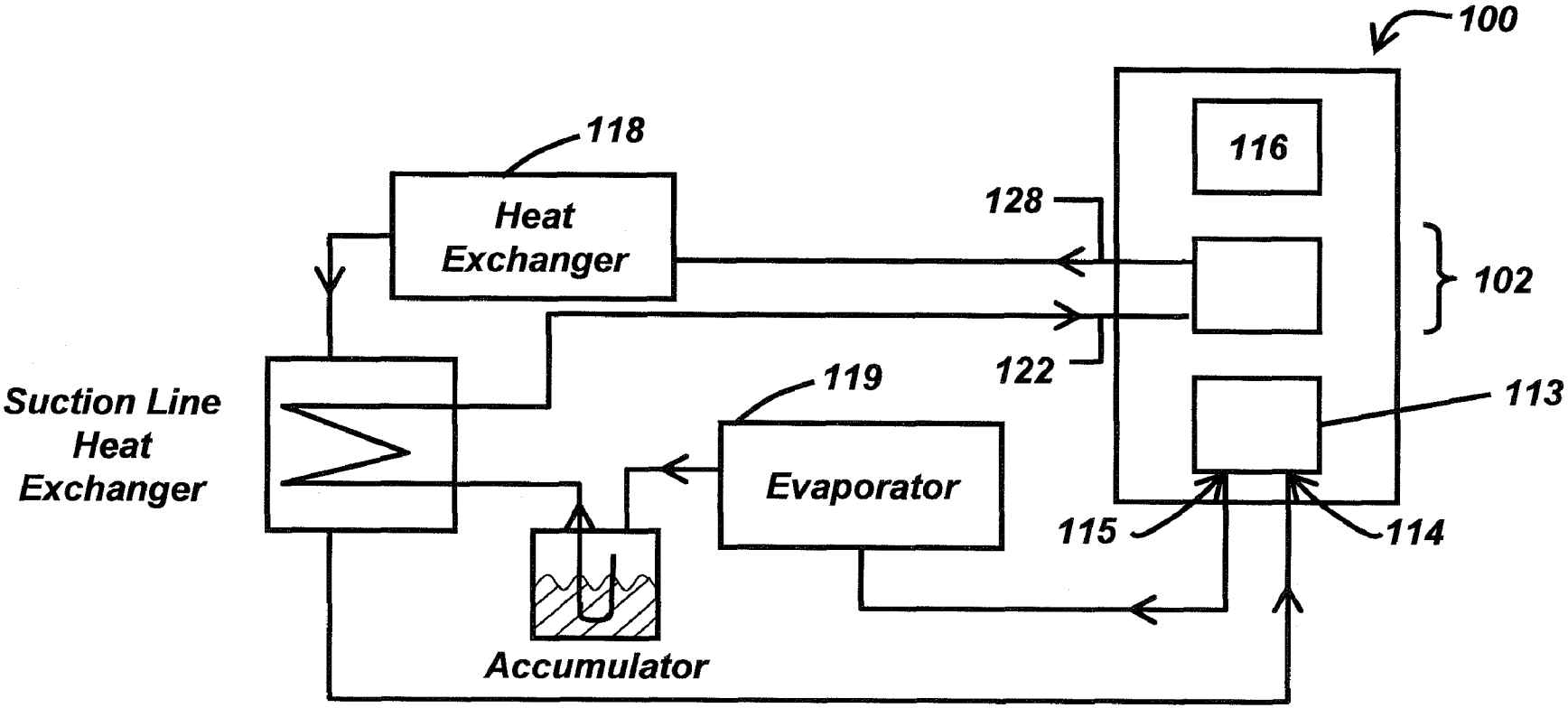
FIG. 1B is a schematic illustration showing a compression and expansion system in accordance with one or more embodiments of the invention.
Figure 2:
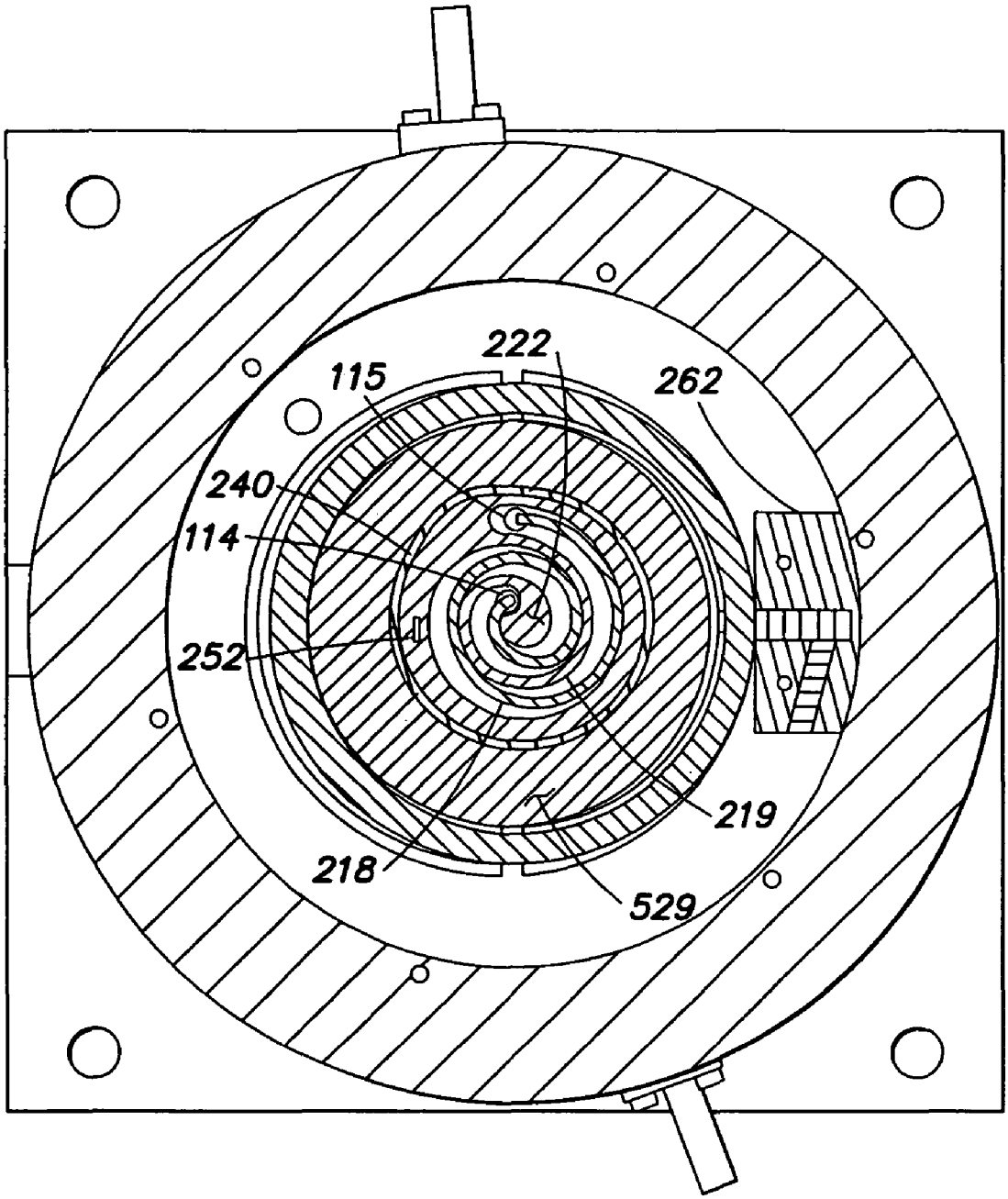
FIG. 2 is a schematic illustration showing a portion of an asymmetric scroll expander having an inlet port, an outlet port, an oil inlet port, and an oil pump in accordance with one or more embodiments of the invention.

System 100 can further comprise one or more prime movers, such as an engine or motor 116, that drive or provide mechanical energy to one or more of first compression stage 110 and/or second compression stage 112. Thus, for example, a shaft 117 can be coupled to motor 116 and provide mechanical energy to one or both compression stages. Further illustrated in FIG. 1 is an inlet port 122 and an outlet port 124 of vessel 109, each typically fluidly connected to one or more unit operations in a refrigeration system. For example, referring to FIG. 1B, inlet port 122 can fluidly connect an evaporator 118 to first compression stage 110. Outlet port 124 can fluidly connect an outlet 112 of first compression stage 110 to other devices. Optionally, a second inlet port 126 can be fluidly connected to second compression stage 111, and a second outlet port 128 can fluidly connect second compression stage 111 to one or more heat exchangers 119 or gas coolers.

First compression stage 110 typically has at least one discharge port 112, which can be in fluid communication with an inlet port 126 of second compression stage 111. As exemplarily shown in FIG. 1, discharge port 112 can also be in fluid communication with one or more expansion devices 113. In some cases, expansion device 113, or at least a portion, or one or more components, thereof, can be in fluid communication with an outlet port of first compression stage 110 and/or an inlet port of second compression stage 111. Thus, in accordance with one or more embodiments of the invention, at least one or more expansion devices 113, or components thereof, can be exposed to a state of a fluid from an outlet port of a first compression stage and/or an inlet port of a second compression stage.

Expansion device 113 can comprise one or more inlet ports 114 and one or more outlet ports 115. Expansion device 113 can comprise a scroll-type expansion device as partially illustrated in FIGS. 2 and 3. The scroll-type device can have an asymmetrical character such that, for example, a length of a fixed scroll element 219 is about one wrap greater than a length of an orbiting scroll element 218. The length of orbiting scroll element 218, in some cases, can be about one-half wrap shorter, at each end thereof, relative to the length of fixed scroll element 219. Such features can facilitate smoothing axial load variation, as discussed below.

In accordance with yet another embodiment of the invention, a bulb-shaped area 222 can be provided at a terminal end of fixed scroll element 219 to facilitate operation of the device at high pressure and loading conditions. Bulb-shaped area 222 can accommodate load distribution and serve as a thrust bearing between the orbiting member and the fixed member. Thus, a squeeze film of a fluid, e.g., carbon dioxide or lubricating oil, typically at high pressure, can provide lubrication against a corresponding region of a surface of the orbiting scroll member. Area 222 can also be constructed and arranged to facilitate definition, e.g. creation, of a pocket between the engaged fixed and orbiting scroll elements. For example, area 222 can have a region that facilitates fluid communication between an inlet port and a volume defined between the fixed and orbiting scroll elements at a first relative orbital position and prevents communication at other relative orbital positions.

During operation, a fluid can be introduced into first compression stage 110 at an inlet port 122 and exit at discharge port 112 at a higher pressure, also referred to as interstage pressure. Fluid at the interstage pressure can pressurize vessel 109 such that components or subsystems contained in vessel 109 are exposed to the interstage pressure. In accordance with some embodiments of the invention, discharge port 112 of first compression stage 110 is in fluid communication with inlet port 126 of second compression stage 111, and further in fluid communication with expansion device 113.

Fluid expansion in expansion device 113 typically occurs as orbiting scroll member 338, having orbiting scroll element 218, orbitally translates around fixed scroll member 339. The translation in turn provides mechanical energy that can be directed to one or more unit operations or processes. For example, the orbital translation can be transformed to rotate one or more shafts, which, in turn, can provide mechanical energy that drives, at least partially, one or more processes. Indeed, the rotating shaft can be coupled to, for example, compression subsystem 102, thus providing at least a portion of the operating load thereof and reducing the work energy of the prime mover.

Expansion device 113 can be secured or supported by directed forces. An applied pressure can be utilized to secure one or more components of the expansion device. For example, at least a portion of expansion device 113 can be pressurized or has an exerted pressure on a surface thereof, e.g., an exposed or outer surface. As illustrated, an applied pressure, designated by arrow 310, can be directed on a surface 312 of a member of the illustrated device. Where the expansion device is a scroll expander, an expansion force typically exists, between orbiting scroll member 338 and fixed scroll member 339, that is associated with an expanding fluid in the pocket defined therebetween. Further aspects of the invention thus relate to application of applied pressure 310 to retain the orbiting scroll member, typically in an opposite direction relative to the expansion forces. The resultant applied force against a surface of the orbiting scroll member can have a magnitude that is equal to, in some cases, greater than, the resultant expansion force associated with the expanding fluid in the one or more pockets defined between the orbiting and fixed scroll members of the scroll-type device. The applied force 310, or orbiting member-retaining force, can be provided by one or more processes, or unit operations from a refrigeration system. For example, interstage pressure, the pressure associated with a fluid discharged from the first compression stage, and/or a fluid associated with an inlet of a second compression stage can provide the applied retaining forces. Fluid to be expanded can provide the applied pressure when directed through channel 330 in fluid communication with an inlet port 114 of the expansion device, typically through one or more pockets. In other cases, the scroll-type device 113 can be disposed in an oil sump 428, typically having oil at a pressure greater than atmospheric pressure. The oil can serve as a fluid that provides an applied pressure 310 against the surface of orbiting scroll member 338 of the scroll-type device 113.

An interface 529 can be defined between a surface of the orbiting scroll member and a surface of the fixed scroll member. Interface 529 can serve as a thrust bearing between the orbiting and fixed scroll members. Thus, where the applied pressure on the orbiting scroll member is greater than the axial expansion forces associated with the expanding fluid in the one or more pockets, interface 529 can perform as a thrust bearing serving to secure components of the scroll-type device.

A lubricant can be directed to reduce friction at interface 529 associated with relative orbital translation between the orbiting and fixed scroll members. For example, the scroll-type expansion device can be disposed in or be in fluid communication with oil sump 428, having oil at an oil level that provides a fluid path to the interface. Any suitable lubricant can be utilized. Typically, the lubricant is chemically compatible, does not react, with the wetted components of the refrigeration system and/or the refrigeration fluid. For example, the lubricant can comprise a glycol such as, but not limited to, polyalkylene glycol.

Significantly, such arrangements can similarly secure scroll-type devices in compression service.

The scroll expansion device can have any desired number of wraps or involutes that provides the desired extent of expansion. For example, the expansion device can have about or nearly three wraps from inlet port 114 to outlet port 115. Further, the orbiting and corresponding fixed scroll elements can have any suitable and/or desired dimension that provides the engagement and facilitates expansion of a fluid. Typically, the fixed and orbiting scroll elements are sized to be rigid and have negligible deflection. Thus, depending on, inter alia, the modulus of elasticity of the material of construction, the orbiting and/or the fixed scroll elements can have a thickness that is about 0.1 inches. Likewise, any suitable scroll pitch can be utilized. For example, the orbiting scroll and fixed scroll elements can have a pitch of about 0.4 inches. Similarly, the orbiting, and corresponding fixed, scroll elements can have any suitable or desired height provided that, depending on the material of construction, can provide expansion processes without any appreciable deflection. For example, the scroll elements can have a flank height of about 0.274 inches. Any suitable orbiting radius can be utilized that provides a corresponding expansion effect including, for example, a radius of about 0.1 inches that correspondingly results in a displacement of about 0.14 cubic inches with an expansion volume ratio of about 2.0. Leakage from the expansion pockets can be controlled by maintaining tight operating clearances between the scrolls.

A seal assembly 240 can be disposed at the interface between the orbiting scroll member 338 and the fixed scroll member 339. As illustrated, seal assembly 240 can be non-circularly shaped and further enclose scroll element 218 and 219 and prevent lubricant introduction into the one or more expansion pockets and separate the zone at interstage pressure from the pressures within the scroll expansion pockets. Seal assembly 240 can be comprised of a groove and a sealing member. The sealing member can be comprised of an elastomeric material.

As discussed, the asymmetric scroll-type device of the invention can be immersed in an oil sump 428. Oil sump 428 can be in fluid communication with the interstage discharge port 112 to allow the oil sump 428 to operate at the interstage pressure. In doing so, the oil sump can provide the pressure to counterbalance the axial pressure force between the orbiting member 338 and the fixed member 339, allowing reducing the reliance on additional thrust bearing devices, and can also provide lubrication to other components of the asymmetric scroll-type device. For example, the oil sump can provide lubrication to the interface 529 defined between orbiting and fixed scroll members. Optional seal assembly 240 serves to prevent any undesired contamination of the expanding fluid with the lubricant. One or more oil or lubricant drain ports 252 can be disposed at an interior region circumferentially defined by seal assembly 240 to capture and redirect any lubricant passing through seal assembly 240 and further inhibit contamination. Further components of the lubrication system can include one or more oil pumps 262. Pump 262 typically charges oil from the oil sump into the conduits to lubricate any desired component of expansion subsystem 103 and, in some cases, any desired component of compression subsystem 102. Pump 262 can be actuated by the orbital translation of the orbiting scroll member or by any suitable mover such as a motor.

Figure 7:
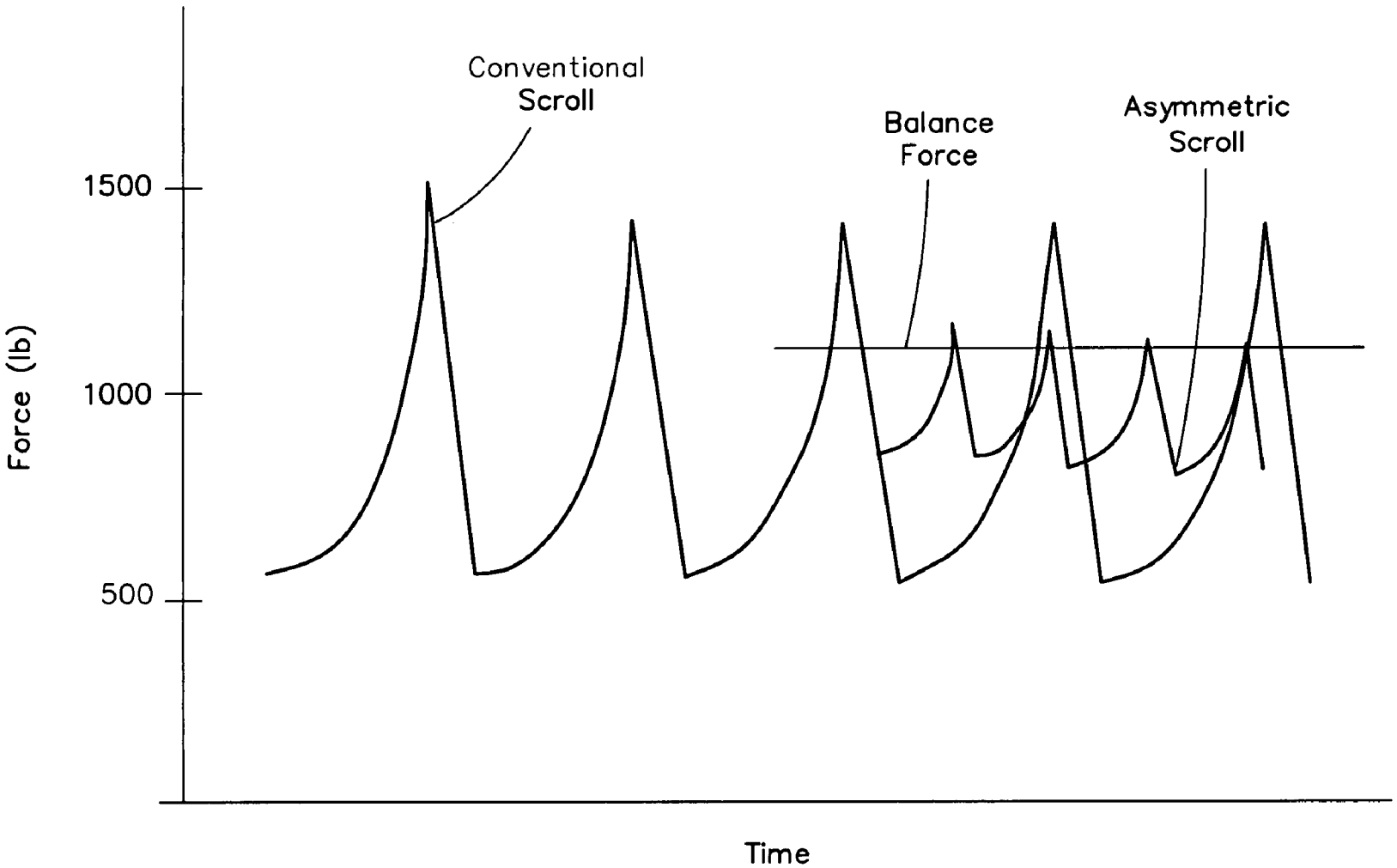
FIG. 7 is a graph showing the axial force relative to time for a typical symmetric expansion device as well as for an asymmetric scroll expansion device in accordance with one or more embodiments of the invention.

Certain aspects related to one or more embodiments of the invention pertain to asynchronously creating pockets in scroll-type devices, e.g., not simultaneously formed. Asynchronous pocket formation can be considered to provide desirable dynamic characteristics. In some cases, the scroll-type device of the present invention can have features that provide reduced axial forces during, for example, fluid expansion processes, relative to conventional scroll-type devices. The axial force can be reduced by dividing the volume of fluid expanded such that, for a total volume, a first portion is introduced and expanded in a first expansion pocket defined between the orbiting and fixed scroll elements in a first relative position, and the balance or another portion is introduced and expanded in a second expansion pocket also defined between the orbiting and fixed scroll elements in a second expansion pocket. Such an arrangement differs from conventional symmetrical processes wherein a fluid is typically introduced into simultaneously defined expansion pockets. The asymmetrical expansion pockets of the present invention provide temporal distribution of the peak associated forces during expansion. Indeed, as illustrated in FIG. 7, which shows the simulated axial forces (lb.) as a function of time, the associated axial forces of the asymmetric scroll expansion device of the present invention can have a peak-to-valley amplitude that is less than half of the peak-to-valley forces associated with standard scroll expansion devices. FIG. 7 also illustrates the relative magnitude of the applied forces associated with balancing or securing the, for example, orbiting member of the scroll-type expansion device. Thus, by temporally shifting and/or dividing the volume of fluid to be expanded, the associated expansion forces can be reduced. The reduced associated forces advantageously reduce friction losses associated with relatively larger components.

Figure 8A:
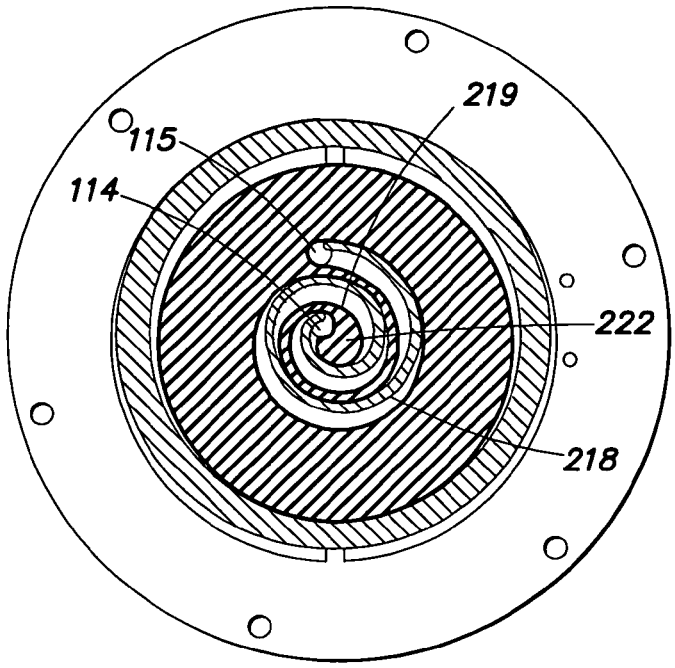
FIGS. 8A-8J are schematic illustrations showing engagement positions (in 90-degree increments from 0-degrees to 810-degrees) of an orbiting scroll element relative to a fixed scroll element of an asymmetric scroll expander, in accordance with one or more embodiments of the invention.
Figure 8B:
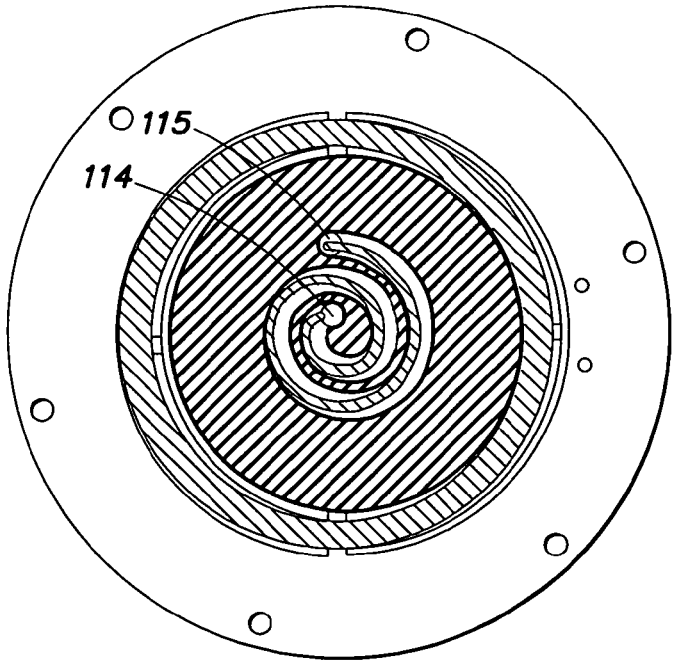
Figure 8C:
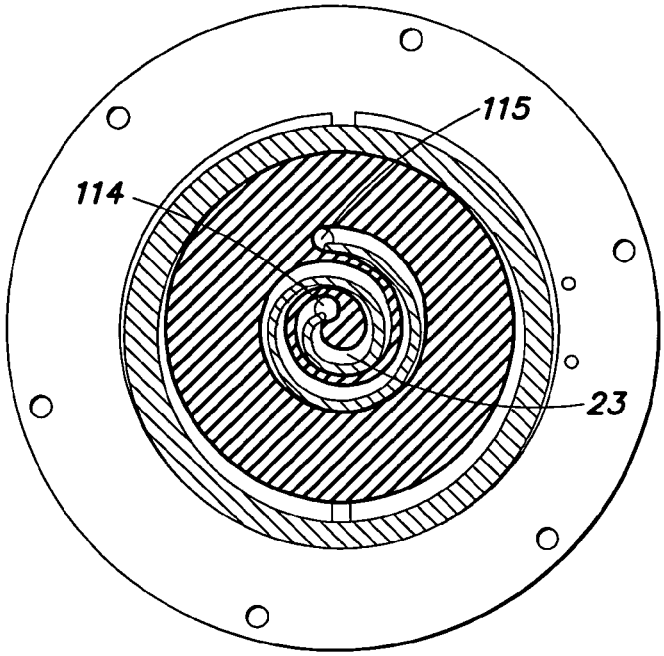
Figure 8D:
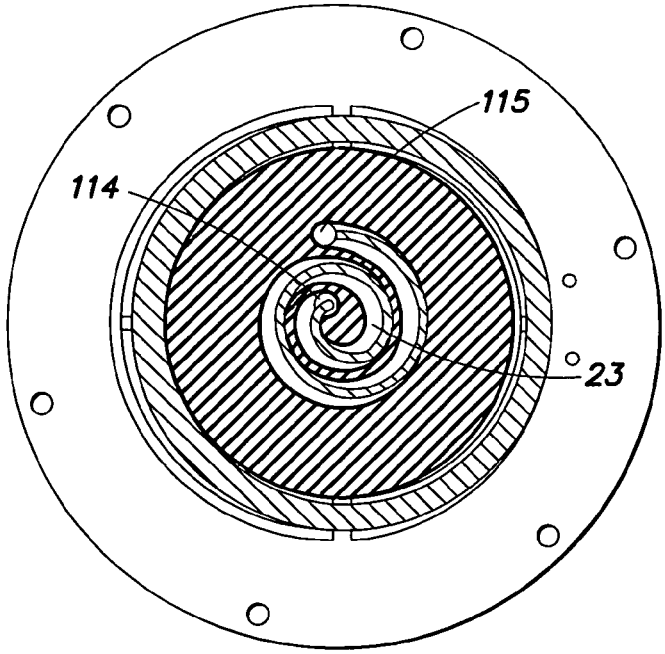
Figure 8E:
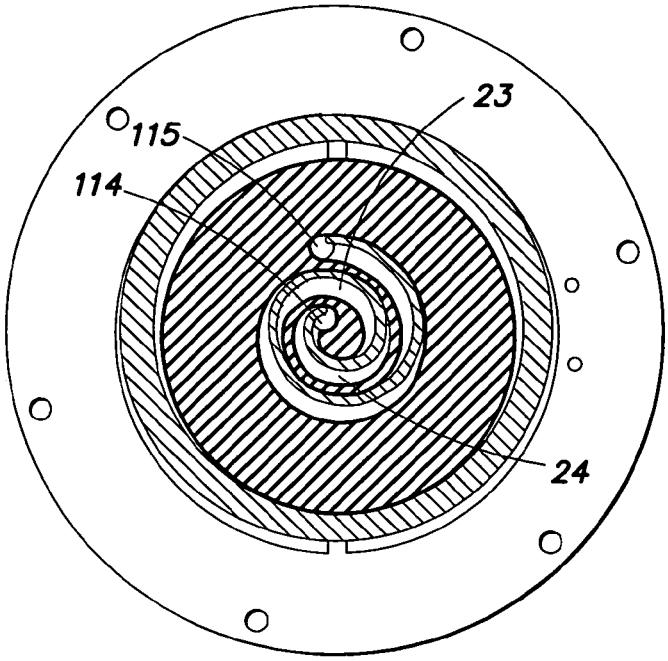
Figure 8F:
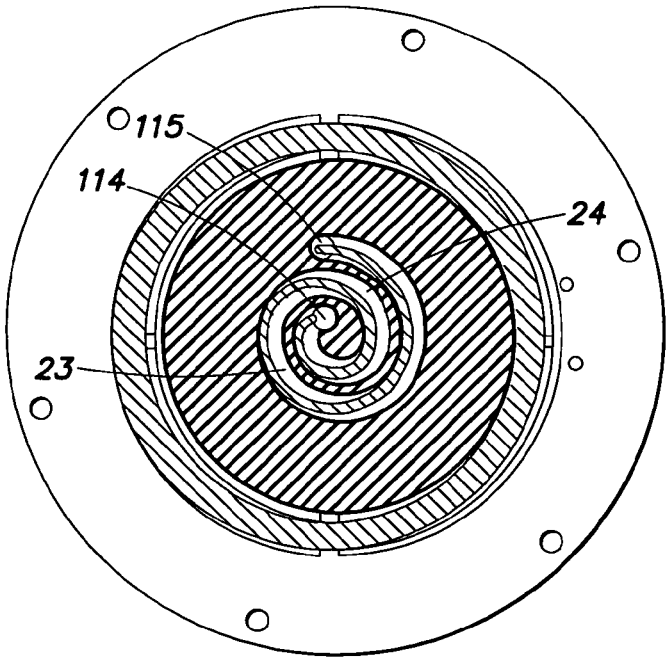

FIGS. 8A-8J show various views of the asymmetric scroll expander configuration in relative orbital motion in accordance with one or more embodiments of the invention. The asymmetrical scroll expander has an orbiting scroll element that is one-half turn shorter, at an inner end, and one-half turn shorter, at an outer end, relative to the length of the fixed scroll element. In accordance with one or more embodiments of the invention, pressurized fluid to be expanded can enter the asymmetric scroll expander through the inlet port 114 and fill the volume defined between the inner wall of orbiting scroll element 218 and an outer wall of the fixed scroll element 219. As the pressurized fluid enters through the inlet port 114, the orbiting scroll element 218 orbitally translates about the fixed scroll element 219. The pressurized fluid provides an applied pressure that induces an increase in the volume defined by the inner wall of orbiting scroll element 218 and the outer wall of fixed scroll element 219. As schematically shown in FIG. 8C, when orbiting scroll element 218 is at an engagement position of about 180 degrees offset relative to fixed scroll element 219, a first expansion pocket 23 is defined or formed between the inner wall of orbiting scroll element 218 and the outer wall of fixed scroll element 219. The first expansion pocket 23 is defined when the volume of pressurized fluid is no longer in fluid communication with the inlet port 114. Pressurized fluid continues to expand and the volume of pressurized fluid between the inner wall of fixed orbiting scroll element 218 and the outer wall of fixed scroll element 219 increases. As this occurs, first expansion pocket 23 effectively moves towards the outlet port 115, as progressively shown in FIGS. 8D to 8H. Simultaneously, pressurized fluid continues to enter through the inlet port 114 into a forming second pocket. When orbiting scroll element 218 is at a second engagement position relative to fixed scroll element 219, a second expansion pocket 24 is formed between the outer wall of the orbiting scroll 218 and the inner wall of the fixed scroll 219, as shown in FIG. 8E. The asynchronously formed second pocket advantageously facilitates redistribution of axial loadings. The second-formed expansion pocket can have a reduced initial volume, or at least a volume that differs from the initial volume of the first pocket.

Figure 8G:
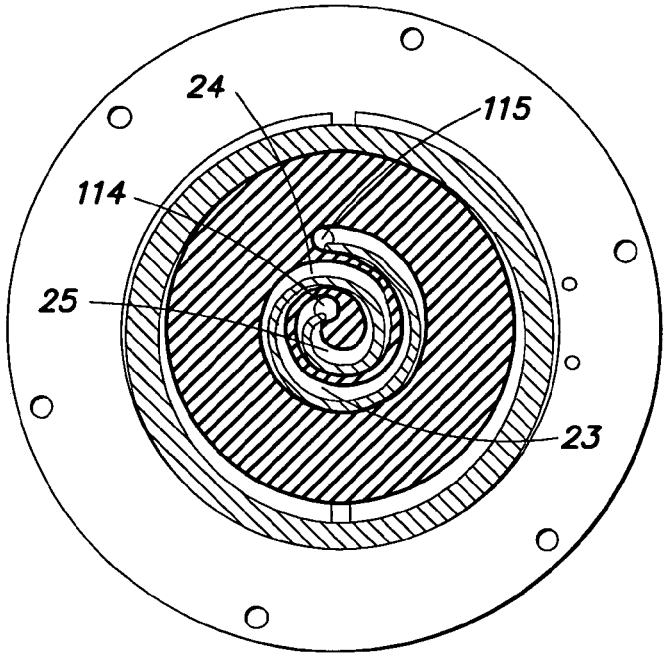

As the first expansion pocket 23 and the second expansion pocket 24 expand, the respective volume also increases, as progressively shown in FIGS. 8F-8I. As fixed orbiting scroll element 218 moves to a position where the volume of pressurized fluid is separated from the inlet port 114, a third expansion pocket 25 is formed between the inner wall of fixed orbiting scroll element 218 and the outer wall of fixed scroll element 219, as shown in FIG. 8G.

Figure 8H:
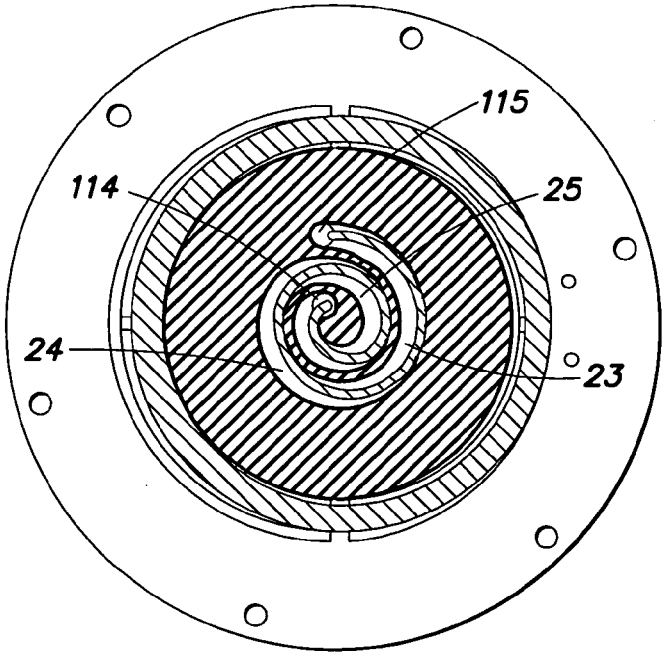
Figure 8I:
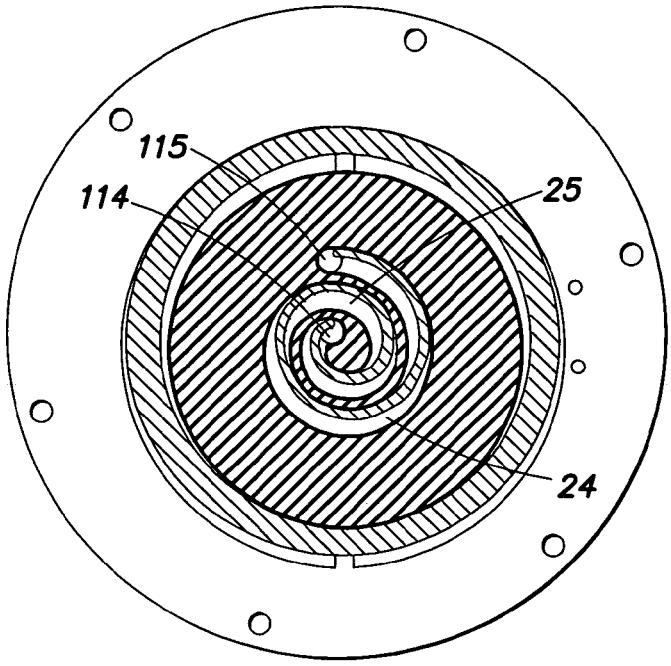
Figure 8J:
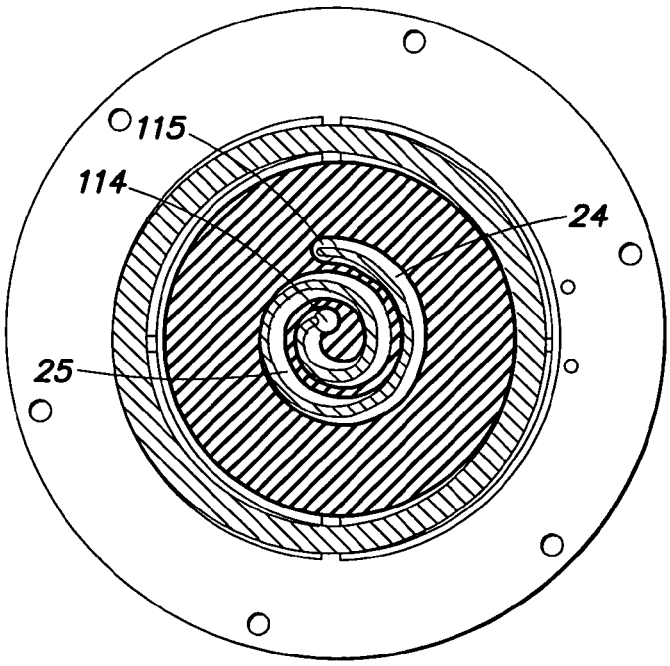

As the orbiting scroll translates, the first expansion pocket 23 becomes fluidly connected to the outlet port 115 and the expanded fluid exits therethrough, as illustrated in FIG. 8H. The second expansion pocket 24 and the third expansion pocket 25 continue to progressively expand while motivating translation of the orbiting scroll member. This process continues with the second expansion pocket 24, third expansion pocket 25, and all other subsequent expansion pockets formed releasing the fluid through the outlet port 115, as progressively illustrated in FIGS. 8I to 8J. In some cases, the third pocket can be considered as equivalent to first pocket 23. In some cases, the third pocket can be considered as equivalent to first pocket 23.

The function and advantages of these and other embodiments of the invention can be further understood from the example below, which illustrates the benefits and/or advantages of the one or more systems and techniques of the invention but do not exemplify the full scope of the invention.

Example

In this example, an asymmetric scroll expander is simulated and the performance of a cooling system utilizing the asymmetric expander is characterized. The design operating conditions of the asymmetric scroll expander suitable for use in an integrated carbon dioxide cooling compressor/expander assembly are listed in Table 1 below.

The length of the fixed scroll is one wrap longer than the length of the orbiting scroll. In particular, the involute of the fixed scroll element wrapped from 0 and extended to about $6\pi$ and the involute of the orbiting scroll element wrapped from an angle of about $\pi$ to about $5\pi$.

The scrolls of the asymmetric scroll expander have a pitch of about 0.4 inches, a wall thickness of about 0.1 inches, a wall height of about 0.274 inches, and an orbit radius of about 0.1 inches.

TABLE 1

Asymmetric Expander Design Operating Conditions.

| | |
|---|---|
| Low Pressure (psia) | 699 |
| High Pressure (psia) | 1,800 |
| Expander Volume Inlet Flow (cu in/min) | 579 |

The asymmetric expander is assumed to have a leakage flow of about 20% with a corresponding expected efficiency of about 70%.

Chromium-molybdenum steel can be utilized in the expander because it provides toughness and wear resistance. The machining tolerances are about +/−0.0003 inch on critical scroll wall dimensions, such as flank height.

The calculated expansion volume of the asymmetric scroll expander is about 0.14 cubic inches. The first expansion pocket has a displacement of about 0.086 cubic inches and the second expansion pocket has a displacement of about 0.052 cubic inches. The expansion sequences are substantially depicted in FIGS. 8A-8J.

The ideal expansion ratio is about 1:2.35. The average expansion ratio can be about 1:2 where it is advantageous to do so.

Table 2 lists the design operating conditions of the cooling system utilizing the asymmetric scroll expander. The expander is designed to be integrated with a compressor that delivers about 682 lb/hr of carbon dioxide refrigerant flow at the design operating conditions. In particular, the cooling system can serve as an 18,000 Btu/hr air-conditioning unit.

TABLE 2

Refrigeration System Design Operating Conditions.

| Refrigeration System Operating Conditions: | |
|---|---|
| Refrigerant Evaporating Temperature (° F.) | 55 |
| Evaporator Exit Temperature (° F.) | 60 |
| Gas Cooler Exit Temperature (° F.) | 120 |
| Compressor/Expander Rotational Speed (rpm) | 3,450 |

The asymmetric expander cooling system is estimated to result in a gross capacity increase of about 17% with a reduction in overall compression power input of about 16%, compared to non-expander based refrigeration systems.

Having now described some illustrative embodiments of the invention, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention. For example, components directed at controlling or regulating the orbital translation, e.g., limiting the orbital radius, such as couplings and other similar structures, as well as components directed at regulating the operating conditions of the refrigeration system, such as controllers, sensors, and valve actuators, are contemplated by the systems and techniques of the invention. Further, although many of the examples presented herein involve specific combinations of method acts or system elements, it should be understood that those acts and those elements may be combined in other ways to accomplish the same objectives.

Further, acts, elements, and features discussed only in connection with one embodiment are not intended to be excluded from a similar role in other embodiments.

It is to be appreciated that various alterations, modifications, and improvements can readily occur to those skilled in the art and that such alterations, modifications, and improvements are intended to be part of the disclosure and within the spirit and scope of the invention.

Moreover, it should also be appreciated that the invention is directed to each feature, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the invention as embodied in the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize or be able to ascertain, using no more than routine experimentation, equivalents to the specific embodiments of the invention. It is therefore to be understood that the embodiments described herein are presented by way of example only and that, within the scope of the appended claims and equivalents thereto; the invention may be practiced otherwise than as specifically described.

What is claimed is:

1. A refrigeration system, comprising:

a heat exchanger;

an asymmetric scroll expander having a fixed scroll element;

an orbiting scroll element engaged with and movable along a circular orbit relative to the fixed scroll element, wherein the orbiting scroll element is about one-half wrap shorter at each end relative to the length of the fixed scroll element;

an inlet port configured to receive a refrigerant from the heat exchanger;

a first expansion pocket defined between the orbiting scroll element and the fixed scroll element that becomes closed to the inlet port at a first relative engagement position of the orbiting scroll element and the fixed scroll element; and an outlet port disposed proximate a terminal end of the orbiting scroll element.

2. The refrigeration system of claim 1, wherein the length of the orbiting scroll element is about one-half wrap shorter at each end thereof relative to the length of the fixed scroll element.

3. The refrigeration system of claim 1, wherein the fixed scroll element comprises about three wraps.

4. The refrigeration system of claim 1, further comprising a compression system having at least two compression stages including a first stage and a second stage operatively coupled to the heat exchanger and the asymmetric scroll expander.

5. The refrigeration system of claim 4, wherein the asymmetric scroll expander is disposed within a pressure vessel.

6. The refrigeration system of claim 5, wherein the first stage comprises a first stage discharge port and the second stage comprises a second stage inlet port.

7. The refrigeration system of claim 6, further comprising an oil sump in fluid communication with at least one of the first stage discharge port and the second stage inlet port.

8. The refrigeration system of claim 7, wherein the oil sump is in fluid communication with an interface defined between an orbiting member and a fixed member of the asymmetric scroll expander.

9. The refrigeration system of claim 8, wherein a seal is disposed at the interface defined between the orbiting member and the fixed member of the asymmetric scroll expander.

10. The refrigeration system of claim 9, wherein the seal is a non-circularly-shaped seal.

11. The refrigeration system of claim 8, further comprising an oil drain disposed at the interface.

12. The refrigeration system of claim 6, wherein an outer surface of an orbiting member of the asymmetric scroll expander is in fluid communication with at least one of the first stage discharge port and the second stage inlet port.

13. The refrigeration system of claim 6, wherein an outer surface of a fixed member of the asymmetric scroll expander is in fluid communication with at least one of the first stage discharge port and the second stage inlet port.

14. The refrigeration system of claim 1, further comprising:

an evaporator having an evaporator inlet port in fluid communication with the outlet port of the asymmetric scroll expander; and a compressor in fluid communication with the evaporator and the heat exchanger.

15. The refrigeration system of claim 14, further comprising a suction line heat exchanger thermally coupling a fluid from the heat exchanger to a fluid from the evaporator.

16. The refrigeration system of claim 15, further comprising a refrigerant accumulator in fluid communication with the evaporator.

17. The refrigeration system of claim 14, wherein the refrigerant comprises a transcritical refrigerant.

18. The refrigeration system of claim 17, wherein the transcritical refrigerant comprises carbon dioxide.

19. The refrigeration system of claim 1, wherein the asymmetric scroll expander further comprising a suction line heat exchanger between the heat exchanger and the inlet port along a flow path of the refrigerant.

20. The refrigeration system of claim 1, further comprising an evaporator between the heat exchanger and the outlet port along a flow path of the refrigerant.

21. The refrigeration system of claim 1, wherein the asymmetric scroll expander further comprises a second expansion pocket defined between the orbiting scroll element and the fixed scroll element that becomes closed to the inlet port at a second relative engagement position.

22. The refrigeration system of claim 21, wherein the fixed scroll element has a bulb-shaped terminal end proximate the inlet port.

23. A method of refrigeration, comprising:

providing an asymmetric scroll expander having an inlet port, a fixed scroll element having a terminal end proximate the inlet port, an orbiting scroll element engaged with and movable along a circular orbit relative to the fixed scroll element, wherein the orbiting scroll element is about one-half wrap shorter at each end relative to the length of the fixed scroll element, and an outlet port proximate a distal, end of the fixed scroll element from the terminal end, introducing refrigerant into a first expansion pocket defined between the orbiting scroll element and the fixed scroll element that becomes closed to the inlet port at a first relative engagement position of the orbiting scroll element and the fixed scroll element, and introducing refrigerant into a second expansion pocket defined between the orbiting scroll element and the fixed scroll element that becomes closed to the inlet port at a second relative engagement position of the orbiting scroll element and the fixed scroll element.

24. The method of claim 23, wherein the orbiting scroll element is coupled to a drive shaft and refrigerant expansion within at least one expansion pocket of the asymmetric scroll expander induces rotation of the drive shaft as mechanical work.

25. The method of claim 24, wherein the refrigerant is transferred from the inlet port to an outlet of the asymmetric scroll expander thereby inducing a rotation of the drive shaft as mechanical work.

26. The method of claim 25, wherein the drive shaft is coupled to a compressor shaft.

27. The method of claim 23, further comprising exposing at least a portion of an outer surface of an orbiting member of the asymmetric scroll expander to the refrigerant thereby creating an applied force thereon.

28. The method of claim 23, further comprising exposing at least a portion of an outer surface of a fixed scroll member of the asymmetric scroll expander to the refrigerant thereby creating an applied force thereon.

29. The method of claim 23, further comprising introducing refrigerant into a compressor having a compressor shaft; and at least partially driving the compressor shaft with mechanical work delivered to the compressor shaft by the asymmetric scroll expander.

30. The method of claim 29, wherein the compressor is a compression system having at least two compression stages.

31. The method of claim 30, wherein a first stage of the compression system discharges refrigerant at an inter-stage pressure.

32. The method of claim 31, further comprising exposing at least a portion of an exposed surface of an orbiting member of the asymmetric scroll expander to the refrigerant at the inter-stage pressure thereby creating an applied force thereon.

33. The method of claim 32, wherein the applied force secures the orbiting member against a fixed member of the asymmetric scroll expander during orbital translation of the orbiting member.

34. The method of claim 32, wherein a magnitude of the applied force is greater than or about equal to a magnitude of an expansion force associated with expansion of the refrigerant in at least one of the expansion pockets.

35. The method of claim 31, further comprising exposing at least a portion of an exposed surface of a fixed scroll member of the asymmetric scroll expander to the refrigerant at the inter-stage pressure thereby creating an applied force thereon.

36. The method of claim 23, further comprising cooling refrigerant in a heat exchanger upstream of the asymmetric scroll expander.

37. The method of claim 23, further comprising flowing refrigerant through the outlet port of the asymmetric scroll expander to an evaporator, and then flowing refrigerant to the heat exchanger.

38. The method of claim 23, wherein the fixed scroll element has a bulb-shaped terminal end.

* * * * *